US008246094B2

(12) United States Patent
Long et al.

(10) Patent No.: US 8,246,094 B2
(45) Date of Patent: Aug. 21, 2012

(54) CLAMPING TWEEZERS

(75) Inventors: Ping-Fa Long, Guangdong (CN); Wei-Peng Liang, Guangdong (CN); Yuan-Fu Tian, Guangdong (CN)

(73) Assignees: Premier Image Technology (China) Ltd., Foshan, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 13/033,606

(22) Filed: Feb. 24, 2011

(65) Prior Publication Data

US 2012/0126557 A1 May 24, 2012

(30) Foreign Application Priority Data

Nov. 24, 2010 (CN) ..... 2010 1 0557889

(51) Int. Cl.
*B25B 9/02* (2006.01)

(52) U.S. Cl. ..... 294/99.2

(58) Field of Classification Search ..... 294/3, 25, 294/8.5, 16, 33, 99.2; 606/205, 210, 211; 30/142

See application file for complete search history.

(56) References Cited

U.S. PATENT DOCUMENTS

| | | | | | |
|---|---|---|---|---|---|
| 2,601,766 | A * | 7/1952 | Riddell et al. | ..... | 30/124 |
| 3,889,995 | A * | 6/1975 | Lin | ..... | 294/99.2 |
| 4,318,313 | A * | 3/1982 | Tartaglia | ..... | 294/99.2 |
| 4,461,297 | A * | 7/1984 | Sutter | ..... | 294/99.2 |
| 4,852,929 | A * | 8/1989 | Shafir | ..... | 294/99.2 |
| D350,465 | S * | 9/1994 | Walsky | ..... | D8/52 |
| D452,936 | S * | 1/2002 | Grisoni | ..... | D28/55 |
| 2006/0091684 | A1 * | 5/2006 | Frauscher | ..... | 294/99.2 |

* cited by examiner

*Primary Examiner* — Paul T Chin
(74) *Attorney, Agent, or Firm* — Altis Law Group, Inc.

(57) ABSTRACT

Clamping tweezers include two elastic arms, two grips, and an adjustment block. The two elastic arms are connected to each other at one end to form a connected end, and start to open from the connected end. Each elastic arm defines a number of spaced grooves adjacent to the connected end. The two grips are rotatably positioned on the distal ends of the two elastic arms, and include two gripping surfaces that face to each other. The adjustment block fits over the two elastic arms from the connected end, and includes teeth and an elastic piece configured for allowing the teeth to engage with the grooves. The adjustment block is able to slide along the elastic arms to adjust an open angle of the two elastic arms.

10 Claims, 5 Drawing Sheets

CLAMPING TWEEZERS

BACKGROUND

1. Technical Field

The present disclosure relates to clamping tweezers.

2. Description of Related Art

When removing components from a printed circuit board (PCB), such as integrated circuit chips (IC chips), a usual method is to heat the IC chip that needs to be removed with a heat gun to melt the solder joints, then tweeze the IC chip with tweezers and remove the IC chip from the PCB. The IC chip is a thin flat piece, which sometimes cannot be firmly tweezed by the tweezers.

Thus, it is desirable to provide new clamping tweezers that can overcome the described limitations.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
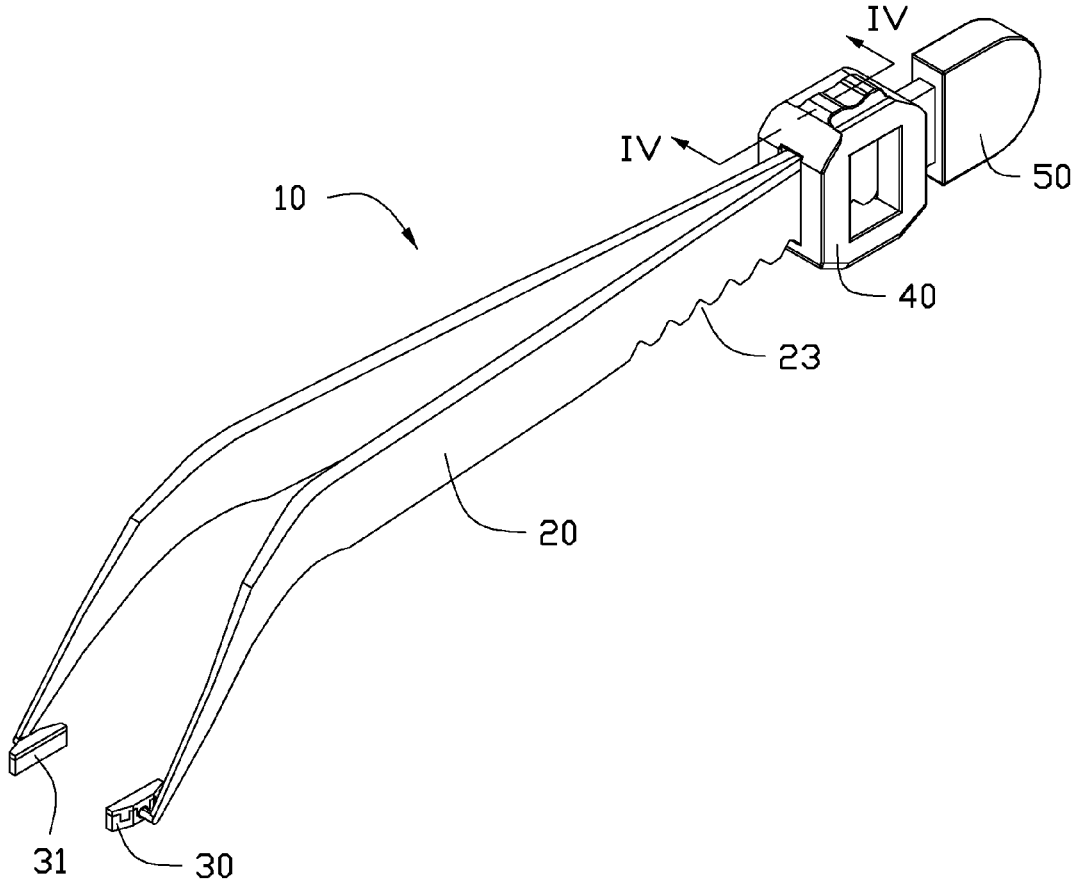
FIG. 1 is a schematic, isometric view of clamping tweezers in accordance with an embodiment.
Figure 2:
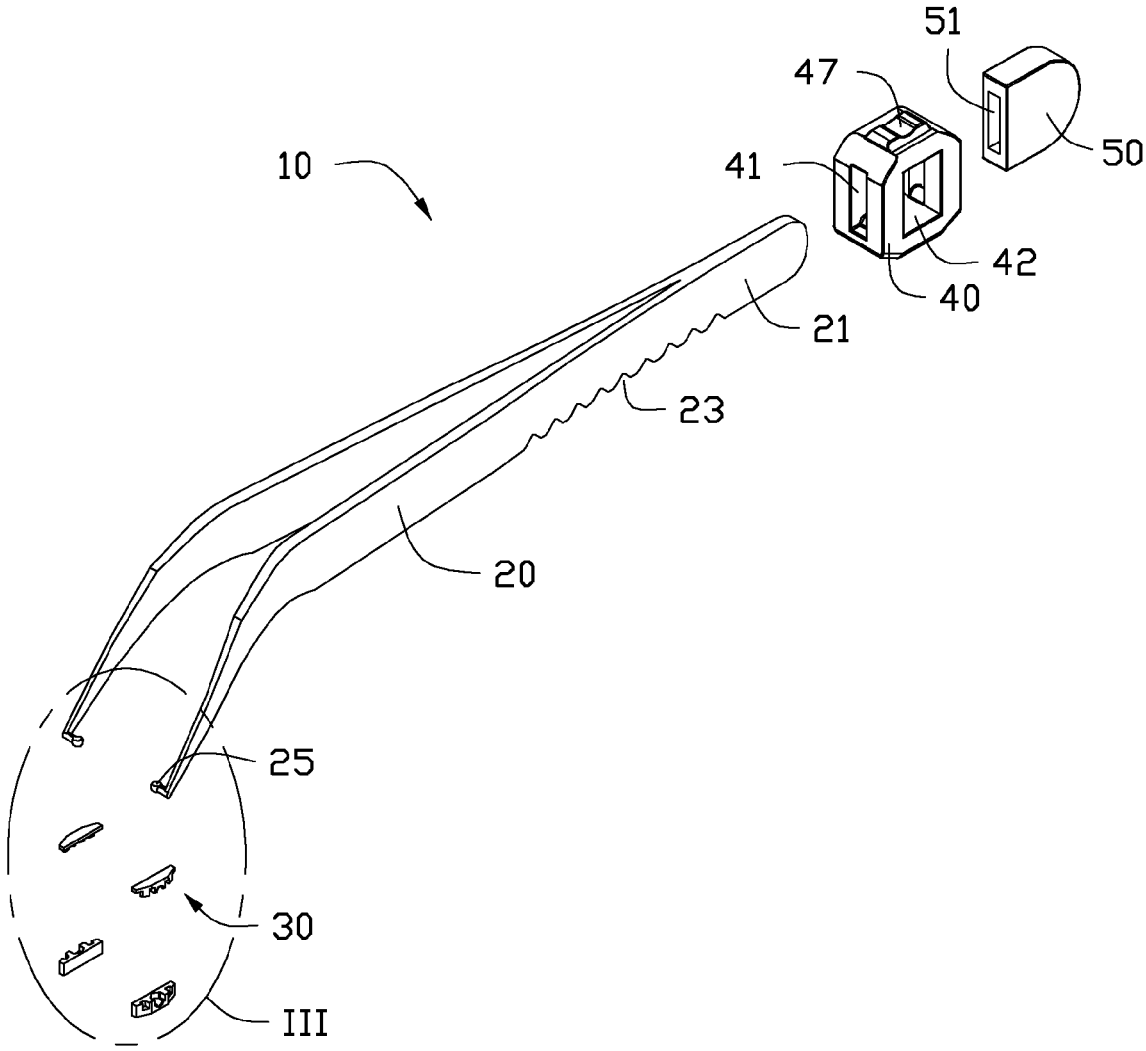
FIG. 2 is a schematic, exploded view of the clamping tweezers of FIG. 1.
Figure 3:
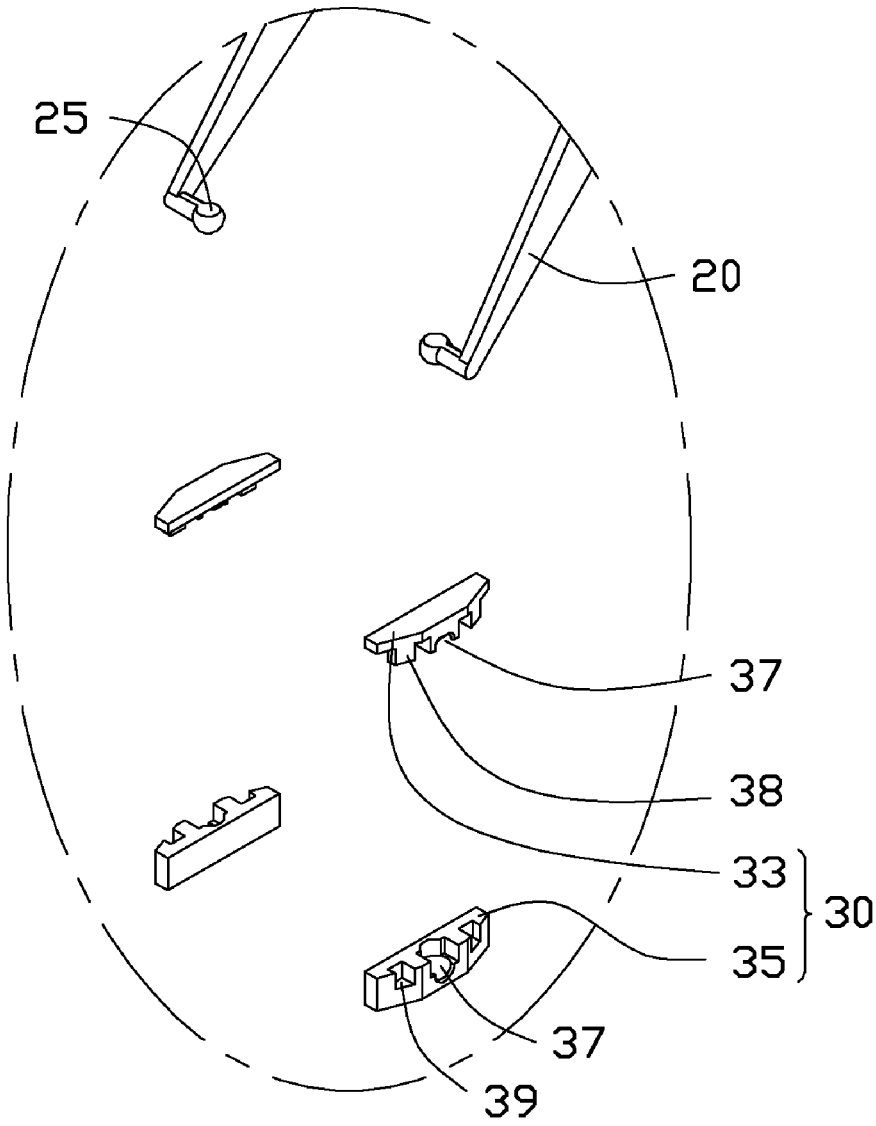
FIG. 3 is an enlarged view of the circled portion III of FIG. 2.
Figure 4:
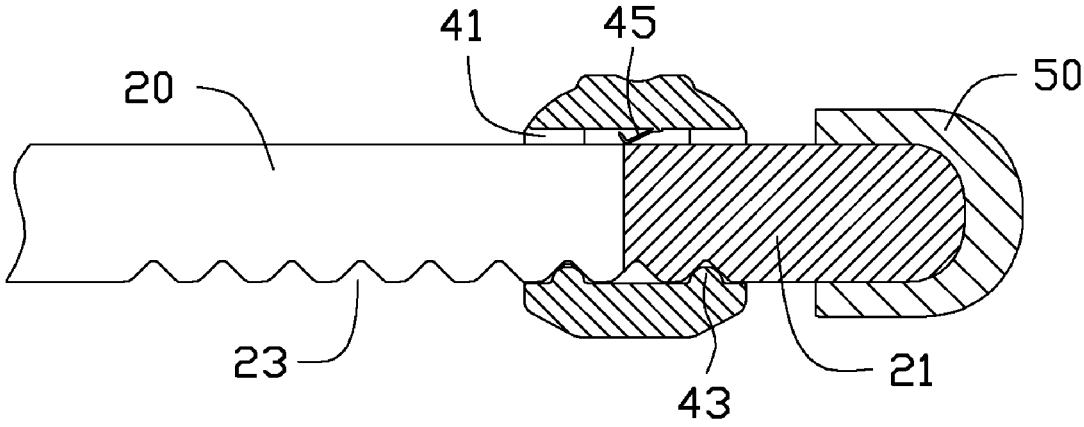
FIG. 4 is a partial, cross-sectional view taken along line IV-IV of FIG. 1.

Referring to FIGS. 1 to 4, clamping tweezers 10 according to an embodiment is disclosed. The clamping tweezers 10 include two elastic arms 20, two grips 30, an adjustment block 40, and a cap 50.

The elastic arms 20 are long, thin, flat pieces. One ends of the two elastic arms 20 are connected to each other, forming a connected end 21. The two elastic arms 20 start to open from the connected end 21. The distal ends of the two elastic arms 20 are bent and gradually diminish from the bent section. The distal ends of the two elastic arms 20 define two balls 25 that are adjacent to each other. The two elastic arms 20 define a plurality of evenly spaced locking grooves 23 on the bottom edge of the two elastic arms 20 that are adjacent to the connected end 21.

The two grips 30 are rotatably connected with the two balls 25. The two grips 30 include gripping surfaces 31 that are adjacent to each other. The gripping surfaces 31 are substantially flat. Each of the grips 30 includes an upper grip 33 and a lower grip 35. The upper grip 33 and the lower grip 35 respectively define tongues 38 and grooves 39 for engaging with each other, connecting the upper grip 33 and the lower grip 35. The upper grip 33 and the lower grip 35 cooperatively form a socket 37 for receiving the ball 25. In this way, the grips 30 are rotatably connected with the elastic arms 20.

The adjustment block 40 defines a rectangle through hole 41 for the elastic arms 20 to extend therethrough. The rectangle through hole 41 is equal to or slightly bigger than the connected end 21. The adjustment block 40 includes teeth 43 formed on a bottom wall of the hole 41, and an elastic piece 45 formed on a top wall of the hole 41. The elastic piece 45 is on the opposite side away from the teeth 43. The adjustment block 40 further includes a curved button 47 on the top thereof.

The adjustment block 40 is fit over the elastic arms 20 from the connected end 21. The elastic piece 45 presses the elastic arms 20 to make the teeth 43 engage with the locking grooves 23, thus locking the adjustment block 40 about the elastic arms 20. The adjustment block 40 has a plurality of locking positions corresponding to the locking grooves 23, and different locking positions corresponding to different open angles of the two elastic arms 20. When it is needed to adjust the open angle of the two elastic arms 20, the curved button 47 is pressed to make the elastic piece 45 contract and make the teeth 43 disengage from the locking grooves 23. The adjustment block 40 is pushed to slide along the elastic arms 20 to a corresponding position, to settle in a predetermined position.

The adjustment block 40 further defines a second rectangle through hole 42 perpendicularly crosses with the rectangle through hole 41. The second rectangle through hole 42 makes the adjustment block 40 light.

The cap 50 defines a fixing hole 51. The cap 50 is fit over the connected end 21 firmly to prevent the adjustment block 40 from sliding off the elastic arms 20.

Figure 5:
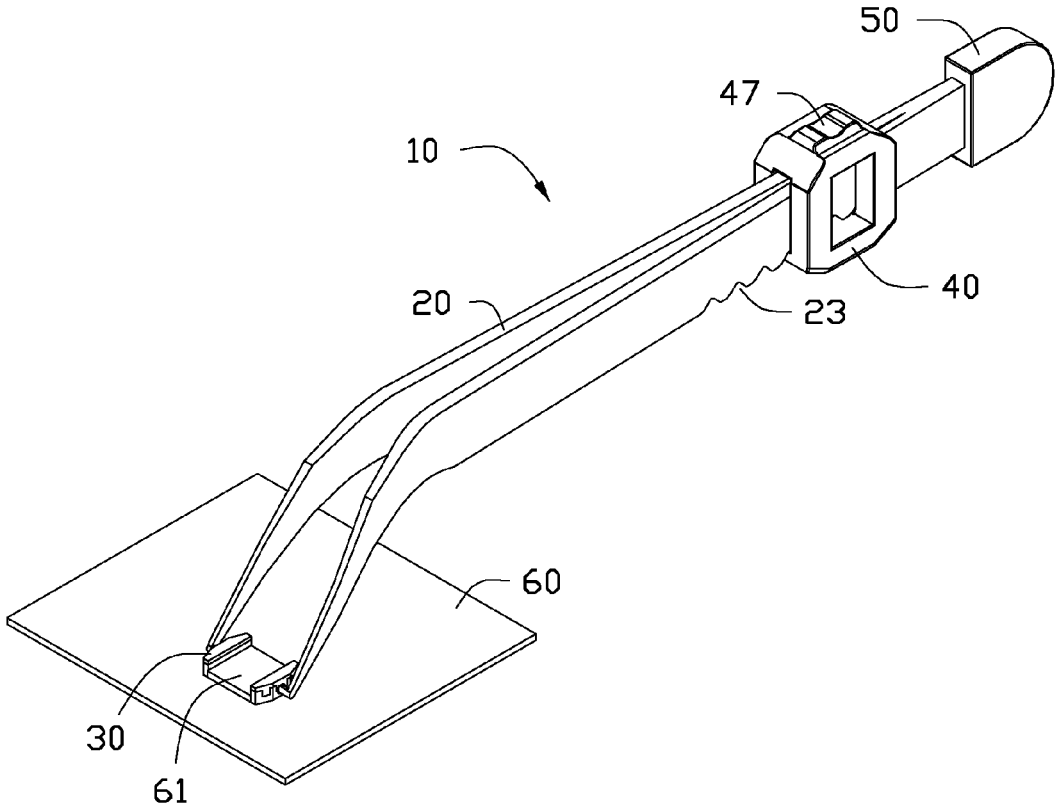
FIG. 5 is a schematic, isometric view of the clamping tweezers of FIG. 1, the clamping tweezers holding an IC chip.

Referring to FIG. 5, when removing a component 61 from a circuit board 60, the adjustment block 40 is pushed towards the connected end 21 to allow the elastic arms 20 to open to a maximum angle, the clamping tweezers 10 are held to the circuit board 60 to locate the component 61 between the two elastic arms 20. The adjustment block 40 is pushed away from the connected end 21 to make the two elastic arms 20 close toward each other. In this way, the component 61 is held by the two grips 30, and can be easily removed from the circuit board 60 with the clamping tweezers 10. When the two grips 30 hold the component 61, the grips 30 rotate to make sure that the gripping surfaces 31 substantially contact with the component 61, firmly holding the component 61.

It will be understood that the above particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. Clamping tweezers comprising:

two elastic arms connected to each other at one ends to form a connected end, wherein the two elastic arms start to open from the connected end, each elastic arm define a number of spaced locking grooves that are adjacent to the connected end;

two grips rotatably positioned on the distal ends of the two elastic arms respectively, and comprising two gripping surfaces that face to each other; and an adjustment block fitting over the two elastic arms from the connected end, wherein the adjustment block comprises teeth and an elastic piece configured for allowing the teeth to engage with the locking grooves, and the adjustment block is capable of sliding along the elastic arms to adjust an open angle of the two elastic arms.

2. The clamping tweezers of claim 1, wherein the elastic arms are long, thin, flat pieces, and the distal ends of the elastic arms are bent and gradually diminish from the bent section.

3. The clamping tweezers of claim 1, wherein the distal ends of the two elastic arms define two balls that are adjacent to each other, each grip comprises an upper grip and a lower grip cooperatively define a socket, the socket receives a corresponding one of the balls.

4. The clamping tweezers of claim 1, wherein the gripping surfaces are substantially flat.

5. The clamping tweezers of claim 1, wherein the adjustment block defines a first through hole, the two elastic arms extend through the first through hole.

6. The clamping tweezers of claim 5, wherein the teeth and the elastic piece are positioned on two opposite sidewalls of the first through hole respectively.

7. The clamping tweezers of claim 6, wherein the adjustment block further comprises a curved button which is far from the teeth, the curved button is configured for being pressed to make the elastic piece contract and make the teeth disengage from the locking grooves.

8. The clamping tweezers of claim 5, wherein the adjustment block further comprises a second through hole perpendicularly crossing with the first through hole.

9. The clamping tweezers of claim 1, further comprising a cap fitting over the connected end.

10. Clamping tweezers comprising:

two elastic arms connected to each other at one ends to form a connected end, wherein the two elastic arms start to open from the connected end, each elastic arm define a number of spaced locking grooves that are adjacent to the connected end;

two grips positioned on the distal ends of the two elastic arms respectively and being rotatable relative to the distal ends, and comprising two gripping surfaces that face to each other; and an adjustment block fitting over the two elastic arms from the connected end, wherein the adjustment block comprises teeth and an elastic piece configured for allowing the teeth to engage with the locking grooves, and the adjustment block is capable of sliding along the elastic arms between the connected end and the distal ends to adjust an open angle of the two elastic arms to a number of values.

* * * * *